US006059357A

United States Patent [19]

Peart

[11] Patent Number: 6,059,357

[45] Date of Patent: May 9, 2000

[54] CHAIR WITH ADJUSTABLE TABLE

[75] Inventor: Stephen Peart, Campbell, Calif.

[73] Assignee: Bernhardt, L.L.C., Lenoir, N.C.

[21] Appl. No.: 09/195,763

[22] Filed: Nov. 18, 1998

[51] Int. Cl.[7] ..... A47B 83/02

[52] U.S. Cl. ..... 297/173; 297/161; 297/188.14

[58] Field of Search ..... 297/135, 161, 297/162, 173, 188.01, 188.14, 188.15, 188.21; 108/66

[56] References Cited

U.S. PATENT DOCUMENTS

| | | | |
|---|---|---|---|
| 818,917 | 4/1906 | Ruger | 297/173 |
| 2,125,920 | 8/1938 | Hayden | 297/135 X |
| 3,680,911 | 8/1972 | Dupuis | 297/162 |
| 3,784,249 | 1/1974 | Hendrickson et al. | 297/162 |
| 3,897,973 | 8/1975 | Long et al. | 297/75 |
| 4,203,624 | 5/1980 | Hopkins | 297/162 |
| 4,213,649 | 7/1980 | Sell | 297/189 |
| 4,840,426 | 6/1989 | Vogtherr et al. | 297/300 |
| 5,114,212 | 5/1992 | Verney et al. | 297/421 |
| 5,215,282 | 6/1993 | Bonutti | 248/118 |
| 5,228,711 | 7/1993 | Summers | 297/161 X |
| 5,281,001 | 1/1994 | Bergsten et al. | 297/411.24 |
| 5,369,805 | 12/1994 | Bergsten et al. | 297/411.35 |
| 5,407,249 | 4/1995 | Bonutti | 297/411.35 |
| 5,439,267 | 8/1995 | Peterson et al. | 297/411.36 |
| 5,490,710 | 2/1996 | Dearing et al. | 297/162 |
| 5,536,070 | 7/1996 | Lemmen | 297/411.37 |
| 5,597,207 | 1/1997 | Bergsten et al. | 297/411.35 |
| 5,597,208 | 1/1997 | Bonutti | 297/411.35 |
| 5,606,917 | 3/1997 | Cauffiel | 297/135 X |
| 5,653,499 | 8/1997 | Goodall | 297/173 X |
| 5,683,136 | 11/1997 | Baumann et al. | 297/162 |
| 5,720,517 | 2/1998 | Prothro, Sr. | 297/195.11 |
| 5,746,480 | 5/1998 | Bonutti | 297/411.35 |
| 5,765,909 | 6/1998 | Catrinar | 297/146 |
| 5,765,911 | 6/1998 | Sorenson | 297/161 X |

FOREIGN PATENT DOCUMENTS

| | | | |
|---|---|---|---|
| 1229105 | 9/1960 | France | 297/170 |
| 12987 | of 1907 | United Kingdom | 297/162 |
| 292824 | 6/1928 | United Kingdom | 297/173 |

*Primary Examiner*—Peter R. Brown
*Attorney, Agent, or Firm*—Rhodes & Mason, PLLC

[57] ABSTRACT

A combined chair and table structure including a seat having first and second front corners, a first table mount extending upwardly from the first front corner, and a second table mount extending upwardly from the second corner; a first table having a planar, horizontal upper work surface and a planar, horizontal bottom surface; a first mounting mechanism including a linear track attached to the first table bottom surface, and a mount rotatable in the first table mount, the track being slidable in relation to the mount; and a second table rotatably supported on the second table mount.

9 Claims, 3 Drawing Sheets

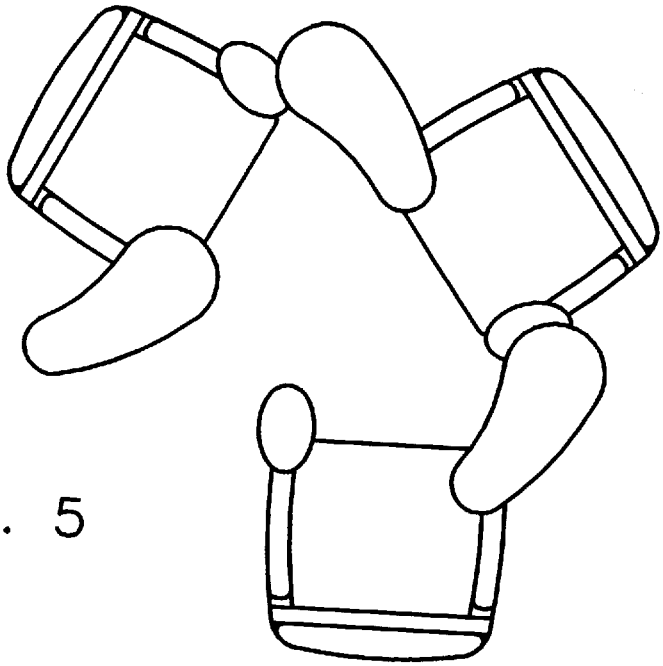
FIG. 5
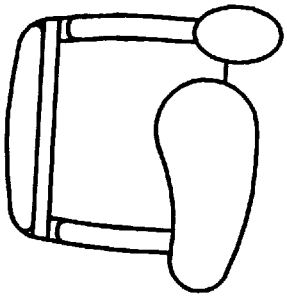
FIG. 6
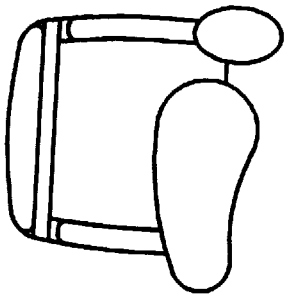
FIG. 7
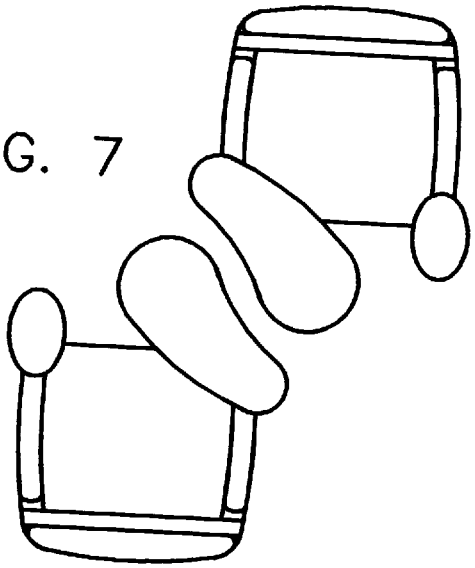

CHAIR WITH ADJUSTABLE TABLE

BACKGROUND OF THE INVENTION (1) Field of the Invention

The present invention relates generally to a combined chair and table, and in particular to a chair having a table mounted thereon that is movable to various positions so that the combined chair and table can be used for a variety of purposes.

(2) Description of the Prior Art

Structures combining a chair and a table or desk are known in the art, as exemplified by chairs with a fixed, enlarged arm of the type used by elementary school students, as well as chairs with a "swing-away" table or desk that can be stored at the side of the chair or moved into a horizontal position for use.

In the business world of today, as well as in many modern domestic environments, there is a need for a combination seat and table that can serve a variety of needs for which a fixed table, or a table moveable only between stored and horizontal positions, would prove inadequate. For example, a single user may need to use a portable computer that rests on a work surface, eat a meal, review materials requiring the availability of a work surface, read, use a telephone, etc. Also, the user may need to confer with colleagues under conditions requiring proximate seating and a shared work surface.

While these needs could be served by the use of multiple chairs and work surfaces of different sizes that are arranged in different positions in relation to the chair, it would be more expeditious and economical to use only one chair with a table or work surface that could be readily adjusted to meet changing needs.

SUMMARY OF THE INVENTION

The present invention provides a combined chair and table, collectively referred to herein as the structure. The table is mounted on the chair in a manner which permits both linear and rotary motion so that the work surface can be moved to any of several positions, making the structure useful for numerous applications.

Generally, the structure of the present invention includes a seat or chair, a first table, and a mounting mechanism to attach the first table to the chair. In addition, the chair may optionally include a second table rotatably mounted at a different position on the chair with a second mounting mechanism.

While the invention is described in terms of a "chair," it will be understood that the invention will be applicable to other forms of seating structures, such as stools, sofas, and the like. Generally, the chair is comprised of a horizontal seating surface upon which the user sits, with the seating surface having opposed sides and opposed front and rear edges joining the sides. The chair also includes one or more seat supports to position the seat at the desired level for sitting. The chair may also include a back section extending upwardly from the rear edge of the seating surface. The seat supports may include an upper surface that may serve to mount the tables, as well as chair arms. Wheels, rollers or casters may be positioned beneath the chair to permit easy movement of the structure to various locations.

The first table has a planar horizontal upper surface, a bottom surface, and opposed sides and ends joined together to form an outer periphery. Preferably, the table ends are outwardly curved or rounded. Also, one side of the surface is preferably outwardly curved, while the other side is inwardly curved.

The periphery of the first work surface is preferably "kidney-shaped," i.e., the periphery is comprised of a combination of outwardly curved ends, one outwardly curved side, and one inwardly or concave curved side. The radius of curvature of one end may be the same or different from the radius of curvature of the other end. In addition, the radius of curvature of one side may be the same or different from the radius of curvature of the other side.

As will be described in greater detail in the detailed description of a preferred embodiment, it has been found that the greatest variety of positions and uses can be achieved with an elongated kidney-shaped first work surface having a periphery comprised of an outwardly curved first end having a first given radius of curvature, an outwardly curved second end having a radius of curvature less than the radius of curvature of the first end, an outwardly curved first side having a second given radius of curvature, and an inwardly curved second side having a radius of curvature less than the second radius of curvature.

The first table is mounted on the chair using a first mounting mechanism that permits the first table to move both linearly and rotatably, so that the table can be positioned at numerous positions relative to the chair, thereby permitting the structure to be used for numerous purposes. The mounting mechanism is comprised of a linear track attached to the lower surface of the first table, with the longitudinal axis of the track inter-secting the ends of the work surface periphery, and a rotatable connector connecting the track and chair.

The rotatable connector is comprised of a horizontal attachment plate slidable along the track, and a vertical post having an upper end secured to the lower surface of the plate and a lower end rotatably insertable into a mount on the chair. Preferably, the first table mount is located at a front corner of the chair. If the seat includes side supports or arms, the socket may extend upwardly from the forward end of one of the arms or side supports.

The structure may also include a second table rotatably attached to another part of the chair. The first and second tables are preferably positioned in vertically spaced apart planes, so that the tables will not contact each other during positioning. Preferably, the first table is mounted in a first horizontal plane, and the second table is mounted in a lower horizontal plane.

The second table may have a planar, horizontal upper surface, a bottom surface, and an outer periphery. Preferably the outer periphery is oval shaped, with opposed outwardly curved sides joining outwardly curved ends. The upper surface may include one or more recesses to receive a cup, work materials, or the like.

The second table may be mounted on the chair using a second mounting mechanism including a mounting plate attached to the bottom surface of the second table, and a downwardly extending post having an upper end attached to the mounting plate and an lower end rotatably inserted into a second mount on the chair. Preferably, the mounting mechanism is attached adjacent one end of the bottom surface of the second table. The first table may be mounted adjacent one front corner of the chair, with the second table being mounted adjacent the other front corner of the chair.

In operation, the user of the structure can sit in the chair and move either of the tables to a desired position by simply exerting a horizontal force against the table in the desired direction of movement. The first table can be moved linearly by sliding the track relative to the attachment plate to position the plate at any desired location between the ends of the track. Thus, the plate can be positioned adjacent either end of the table or at an intermediate point. Additionally, the first table can be rotated at the post relative to the chair.

Using the combination of linear and rotatable motion, the first table can be positioned in numerous positions relative to the chair and its occupant, making the table useful for a variety of functions. In addition, two of the structures can be positioned adjacent each other, and their respective first table positioned to form a common work surface for multiple users.

Accordingly, one aspect of the present invention is to provide a combined seat and table structure comprising a seat having first and second front corners, a first table mount extending upwardly from the first front corner, and a second table mount extending upwardly from the second corner; a first table having a planar, horizontal upper work surface and a planar, horizontal bottom surface; a first mounting mechanism including a linear track attached to the first table bottom surface, and a mount rotatable in the first table mount, the track being slidable in relation to the mount; and a second table rotatably supported on the second table mount.

Other aspects of the present invention will become apparent to those skilled in the art after a reading of the following description of the preferred embodiment.

BRIEF DESCRIPTION OF THE DRAWINGS

FIGS. 5–7 are top views of exemplary arrangements of multiple structures showing different table orientations.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
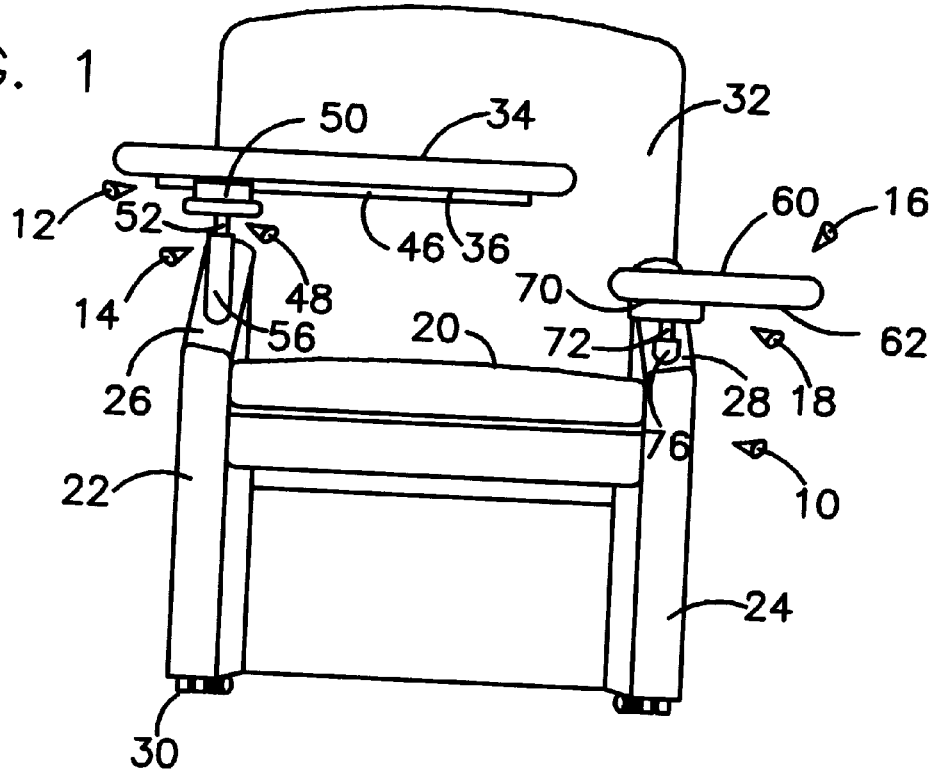
FIG. 1 is a front view of the structure of a preferred embodiment of the invention.
Figure 2:
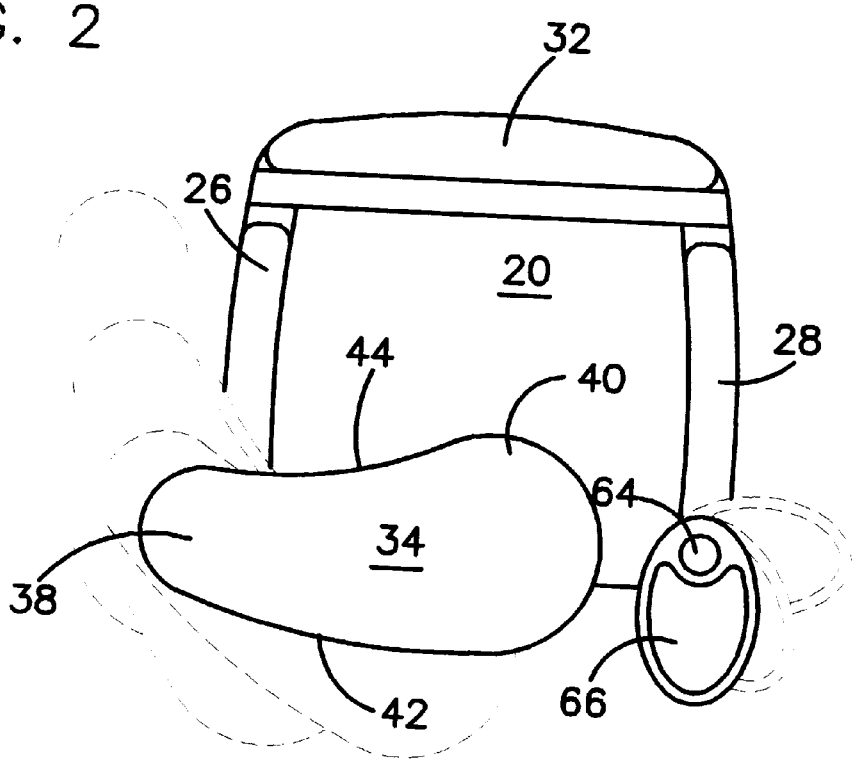
FIG. 2 is top view of the structure with various additional positions of the first and second tables shown in dotted lines.
Figure 3:
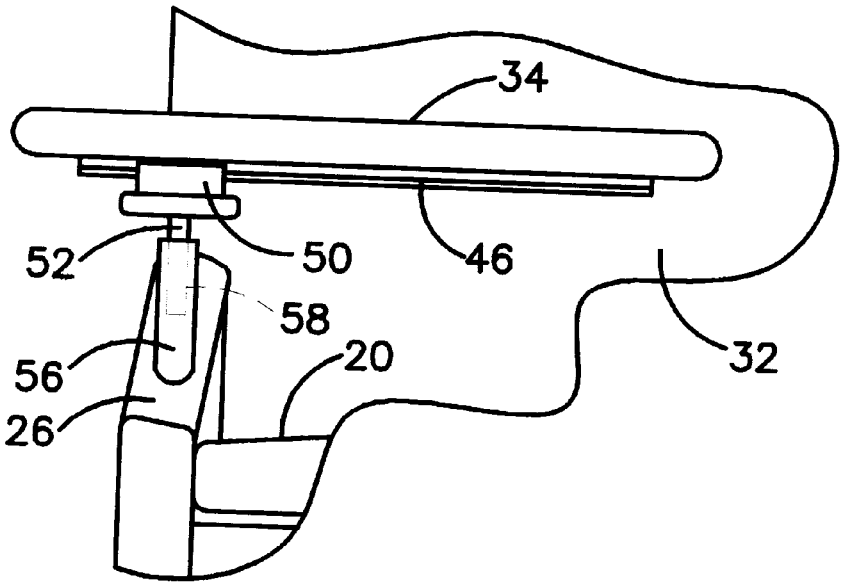
FIG. 3 is an enlarged front view of the first table mounting mechanism, with the first table and a portion of the chair.
Figure 4:
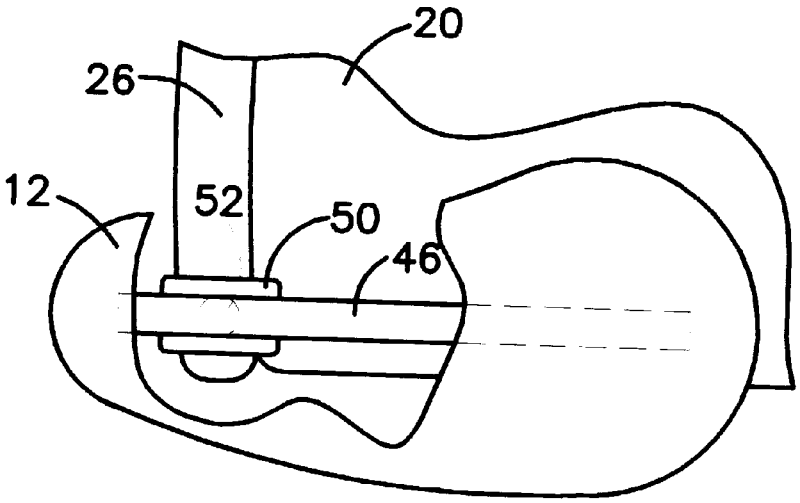
FIG. 4 is an enlarged top view of the mounting mechanism, with parts of the first table broken away and other parts of the first table and chair included to illustrate positioning.

As best illustrated in FIGS. 1–4, the structure of the present invention is comprised of a chair, generally 10, a first table, generally 12, attached to chair 10 with first mounting mechanism 14, and a second table 16, attached to chair 10 with second mounting mechanism 18.

Chair 10 is comprised of a horizontal seating surface 20 having spaced side edges, a front edge joined at a first forward corner to one side edge and a second forward corner to the other side edge, and a rear edge joining the rear ends of the sides. The sides of seating surface 20 are joined to generally upright, spaced side supports 22 and 24, having rearwardly inclined upper surfaces 26 and 28, respectively. Casters 30 are mounted beneath supports 22 and 24. Chair 10 also includes a back section 32 extending upwardly from the rear edge of seating surface 20.

First table 12 includes an elongated, horizontal upper surface 34, and a bottom surface 36. Surface 34 is defined by a generally kidney-shaped, continuous outer periphery. The periphery includes an outwardly curved first end 38 having a first radius of curvature, an outwardly curved second end 40 having a radius of curvature greater than the first radius of curvature, an outwardly curved first side 42 having a second radius of curvature, and an inwardly curved second side 44 having a radius of curvature less than the second radius of curvature.

First mounting mechanism 14, used to attach first table 12 to chair 10, is comprised of a linear track section 46 mounted on bottom surface 36 of table 12, and rotatable connector 48. Track 46 has one end adjacent table end 38 and an opposite end adjacent table end 40, so that the longitudinal axis of track 46 is generally aligned with the longitudinal axis of table 12. Rotatable connector 48 includes an attachment plate 50 secured to and slidable along track 46, and a vertical, downwardly extending, cylindrical mounting post 52 that has an upper end secured to the lower surface of plate 50 and a lower end.

A first table mount 56, including a socket 58 to receive the lower end of post 52, extends upwardly from support 22, adjacent one front corner of chair 10. The longitudinal dimension of table 12 is approximately equal to the width of chair 10, so that table 12 will extend substantially across chair 10 when plate 50 is adjacent one end of track 46 and the longitudinal axis of track 46 is aligned with the front edge of seating surface 20.

Second table 16, is located in a horizontal plane lower than the horizontal plane of table 12, so that the tables will not contact each other during positioning. Table 16 has a horizontal upper surface 60 having an oval periphery with opposed ends, and a bottom surface 62. Upper surface 60 includes first and second recesses 64 and 66 to hold various articles.

Second mounting mechanism 18 is used to mount second table 16 onto chair 10. Mechanism 18 includes mounting plate 70 attached to bottom surface 62 and a downwardly extending post 72 having an upper end attached to plate 70 and a lower end. A second table mount 76, including a socket to receive the lower end of post 72 extends upwardly from support 24, adjacent the other front corner of chair 10. In operation, first table 12 is moved in a linear direction to position plate 50 at the desired position along track 46. Table 12 can also be rotated on post 52 within socket 58 to position table 12 at the desired angular position. In addition, as exemplified by FIGS. 5–7, two or more of the structures can be moved adjacent each other to form cooperative configurations. Second table 16 can also be rotated on post 72 to a desired position.

The tables can be used by a user sitting in the seat in a variety of modes. The structure can be used to meet, relax or work, displacing the need for a workstation or desk. Since the structure uses a much smaller "footprint" than a conventional desk and chair, it can be located in an area of less area than conventional desks, permitting more efficient floor space usage. Furthermore, the tables adjust in a way that the use finds intuitive, so that the user can adjust and refine the tables' positions in a variety of ways, with no lengthy instructions.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A combined chair and table structure comprising:

a) a chair having first and second front corners, a first table mount extending upwardly from adjacent said first front corner, and a second table mount extending upwardly from adjacent said second corner;

b) a first table having a planar, horizontal upper work surface and a planar, horizontal bottom surface, said first table having an outwardly curved first end with a first given radius of curvature, an outwardly curved second end with a radius of curvature less than the radius of curvature of the first end, an outwardly curved first side with a second given radius of curvature, and an inwardly curved second side with a radius of curvature less than the second radius of curvature, c) a first mounting mechanism including a rotatable connector defining a first axis of rotation, said first table being rotatably connected to said connector and slidable with respect thereto, to permit variable positions of said first table with respect to the first axis of rotation such that the first axis of rotation substantially always passes through said first table; and d) a second mounting mechanism for rotationally supporting a second table, said second mounting mechanism defining a second axis of rotation, and said second table being rotatably connected to said second mounting mechanism to permit variable positions of said second table with respect to the second axis of rotation such that the second axis of rotation substantially always passes through said second table.

2. The structure of claim 1, wherein said first and second tables are located in different horizontal planes.

3. The structure of claim 1, wherein said seat includes first and second upright supports with front ends positioned on either side of said seating surface, said first table mount extending upwardly from adjacent the front end of said first support and said second table mount extending upwardly from adjacent the front end of said second support.

4. The structure of claim 1, wherein said chair is mounted on casters.

5. She structure of claim 1, wherein said second table has an oval periphery with opposed ends, said second table mount being adjacent one of said ends.

6. The structure of claim 1, wherein said second table includes a horizontal upper work surface, said surface including at least one recess.

7. The structure of claim 1, wherein said chair has a given width and said first table has a length approximately equal to said given width.

8. The structure of claim 1, wherein said first mounting mechanism further includes a linear track attached to the bottom surface of the first table, said track being slidable in relation to said connector.

9. The structure of claim 8, wherein said first table mount includes a first socket and said connector includes an attachment plate slidably attached to said track and a first post extending downwardly from said plate into said first socket, said first post being rotatable in said first socket.

* * * * *